US007614991B2

(12) United States Patent
Fox

(10) Patent No.: US 7,614,991 B2
(45) Date of Patent: Nov. 10, 2009

(54) TREADMILL DESK

(76) Inventor: Sam Fox, 7701 Forsyth Blvd., Suite 550, St. Louis, MO (US) 63105

( * ) Notice: Subject to any disclaimer, the term of this patent is extended or adjusted under 35 U.S.C. 154(b) by 0 days.

(21) Appl. No.: 11/896,249

(22) Filed: Aug. 30, 2007

(65) Prior Publication Data

US 2008/0058169 A1 Mar. 6, 2008

Related U.S. Application Data

(60) Provisional application No. 60/842,397, filed on Sep. 6, 2006.

(51) Int. Cl.
*A63B 22/02* (2006.01)

(52) U.S. Cl. ..... 483/54; 482/51; 482/52; 482/126

(58) Field of Classification Search ..... 482/54
See application file for complete search history.

(56) References Cited

U.S. PATENT DOCUMENTS

| | | | | |
|---|---|---|---|---|
| 1,919,627 | A * | 7/1933 | Fitz Gerald | 482/7 |
| 2,819,755 | A * | 1/1958 | Berger et. al. | 482/69 |
| 3,671,082 | A * | 9/1973 | Barthel, Jr. | 482/69 |
| 3,761,082 | A * | 9/1973 | Barthel, Jr. | 482/69 |
| 4,655,447 | A * | 4/1987 | Dubrinsky et al. | 482/69 |
| 4,861,021 | A * | 8/1989 | Edwards et al. | 482/69 |
| 4,898,378 | A * | 2/1990 | Edwards et al. | 482/54 |
| 4,913,423 | A * | 4/1990 | Farran et al. | 482/130 |
| 4,948,205 | A | 8/1990 | Kelley | |
| 5,158,510 | A * | 10/1992 | Lemire | 482/51 |
| 5,176,597 | A * | 1/1993 | Bryne | 482/74 |
| 5,199,934 | A * | 4/1993 | Lin | 482/79 |
| 5,746,684 | A * | 5/1998 | Jordan | 482/62 |
| 5,813,947 | A * | 9/1998 | Densmore | 482/51 |
| 5,984,839 | A * | 11/1999 | Corkum | 482/54 |
| 6,021,535 | A * | 2/2000 | Baus et al. | 5/632 |
| 6,210,306 | B1 * | 4/2001 | Miller | 482/54 |
| 6,224,516 | B1 * | 5/2001 | Disch | 482/54 |
| 6,264,584 | B1 * | 7/2001 | Bass | 482/54 |
| 6,283,896 | B1 | 9/2001 | Grunfeld et al. | |
| 6,575,876 | B1 | 6/2003 | Phelps-McMillon | |
| 6,645,126 | B1 * | 11/2003 | Martin et al. | 482/54 |
| 6,666,798 | B2 * | 12/2003 | Borsheim | 482/54 |
| 6,709,368 | B1 * | 3/2004 | Chue | 482/79 |
| 6,808,475 | B2 * | 10/2004 | Kehrbaum | 482/54 |
| 6,837,186 | B1 * | 1/2005 | Terao | 119/700 |
| 6,849,035 | B2 * | 2/2005 | Duvernay et al. | 482/60 |
| 6,908,414 | B1 * | 6/2005 | Roadman | 482/51 |
| 7,066,181 | B2 * | 6/2006 | West | 128/875 |
| 7,128,700 | B2 * | 10/2006 | Wallach | 482/130 |
| 7,137,935 | B2 * | 11/2006 | Clarke et al. | 482/123 |

(Continued)

OTHER PUBLICATIONS

International Search Report and Written Opinion (10 pages).

*Primary Examiner*—Loan H Thanh
*Assistant Examiner*—Robert F Long
(74) *Attorney, Agent, or Firm*—Dickstein Shapiro LLP

(57) ABSTRACT

A treadmill system having a side work surface at a height convenient for a user access for working. The treadmill also has a safety rail that runs longitudinally. A safety belt that may be worn by a user is anchored to the side rail. In one embodiment, the side rail height and the belt are configured to support the weight of the user in case of a fall.

20 Claims, 8 Drawing Sheets

U.S. PATENT DOCUMENTS

| | | | | |
|---|---|---|---|---|
| 7,335,147 | B2 * | 2/2008 | Jones et al. | 482/148 |
| 2002/0142898 | A1 * | 10/2002 | Willis et al. | 482/130 |
| 2003/0008752 | A1 * | 1/2003 | Hsu | 482/55 |
| 2004/0009848 | A1 * | 1/2004 | Lee | 482/57 |
| 2004/0053756 | A1 * | 3/2004 | Tremayne | 482/126 |
| 2004/0147379 | A1 * | 7/2004 | Itrich et al. | 482/126 |
| 2004/0254020 | A1 * | 12/2004 | Dragusin | 463/46 |
| 2005/0009669 | A1 * | 1/2005 | Harris | 482/69 |
| 2005/0014609 | A1 * | 1/2005 | Neff | 482/57 |
| 2005/0054492 | A1 * | 3/2005 | Neff | 482/57 |
| 2005/0255971 | A1 * | 11/2005 | Solomon | 482/54 |
| 2005/0272566 | A1 * | 12/2005 | Otsuka | 482/57 |
| 2005/0272582 | A1 * | 12/2005 | Leib | 482/142 |
| 2005/0282684 | A1 * | 12/2005 | Hakooz | 482/1 |
| 2005/0282690 | A1 * | 12/2005 | Hakooz | 482/148 |
| 2005/0282691 | A1 * | 12/2005 | Hakooz | 482/148 |
| 2006/0247109 | A1 * | 11/2006 | Powell | 482/148 |
| 2006/0258513 | A1 * | 11/2006 | Routley et al. | 482/54 |
| 2006/0264306 | A1 * | 11/2006 | Tischler et al. | 482/148 |
| 2007/0066466 | A1 * | 3/2007 | Jones et al. | 482/148 |
| 2007/0093360 | A1 * | 4/2007 | Neff et al. | 482/8 |
| 2007/0117680 | A1 * | 5/2007 | Neff et al. | 482/8 |
| 2008/0004166 | A1 * | 1/2008 | Oren et al. | 482/142 |
| 2008/0039301 | A1 * | 2/2008 | Halbridge | 482/121 |
| 2008/0070757 | A1 * | 3/2008 | Albert | 482/54 |
| 2008/0081748 | A1 * | 4/2008 | Knapp | 482/130 |
| 2008/0096745 | A1 * | 4/2008 | Perry | 482/148 |
| 2008/0100106 | A1 * | 5/2008 | Dragusin | 297/217.3 |

* cited by examiner

TREADMILL DESK

CROSS REFERENCE TO RELATED APPLICATIONS

The present application is a of U.S. Provisional Patent Application Ser. No. 60/842,397, filed on Sep. 6, 2006.

BACKGROUND

This invention relates to exercise equipment and, in particular, a treadmill having functionalities in addition to an adjustable running surface.

Walking and running are two popular forms of exercise. They use substantially all muscles of the body and require very little mental concentration. Individuals who enjoy walking and running as forms of exercise also find that they are a therapeutic form of exercise as well. Therefore, treadmills have become popular because they may provide a programmable running surface with adjustable inclines and speeds in a very compact space indoors so that individuals may walk and/or run inside in a controlled environment during inclement weather. In addition, many runners prefer running on treadmills to running on pavement, which can be hard on their knees and other joints.

However, as the world becomes more hectic, it has become increasingly difficult for individuals to maintain an exercise schedule, indoors or outdoors. Demands in the workplace include not only high stress, but also prolonged office hours. Office workers spend more time sitting at their desks, often with poor posture, and developing long-term back issues and undesired weight-gain, while, at the same time finding less and less time to exercise. With all the other demands of life such as family, friends, chores and hobbies, exercise often falls lower on the priority list of office workers. When this occurs, office workers may skip exercise as a part of their daily routine and, as a result, their health is compromised.

U.S. Pat. No. 5,813,947 to Densmore, U.S. Pat. No. 5,984,839 to Corkum, U.S. Pat. No. 6,224,516 to Disch, and U.S. Pat. No. 6,283,896 to Grunfeld et al. are some other attempts that have been made to incorporate exercise equipment with computers, work stations, or other activity stations. However, with such distractions as computers, work stations or other activity stations, safety is compromised and a user of such inventions may be prone to falling down and sustaining injuries.

Therefore, it would be desirable if the user could find a way to safely incorporate exercise into the workday, without sacrificing time that is already dedicated to the other demands of their lives.

SUMMARY

The present invention is a treadmill system comprising a treadmill having a running surface with at least one work surface adjacent to the treadmill. The invention includes at least one handrail along the length of the running surface and a safety belt anchored to the at least one handrail. The anchor for the safety belt can slide along the at least one handrail. The system provides a way to incorporate exercise into a workday without sacrificing safety or any additional time that is already dedicated to other demands of an individual's life.

DETAILED DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in sufficient detail to enable those of ordinary skill in the art to make and use the invention, and it is to be understood that structural, logical, or procedural changes may be made to the specific embodiments disclosed without departing from the spirit and scope of the present invention.

Figure 1:
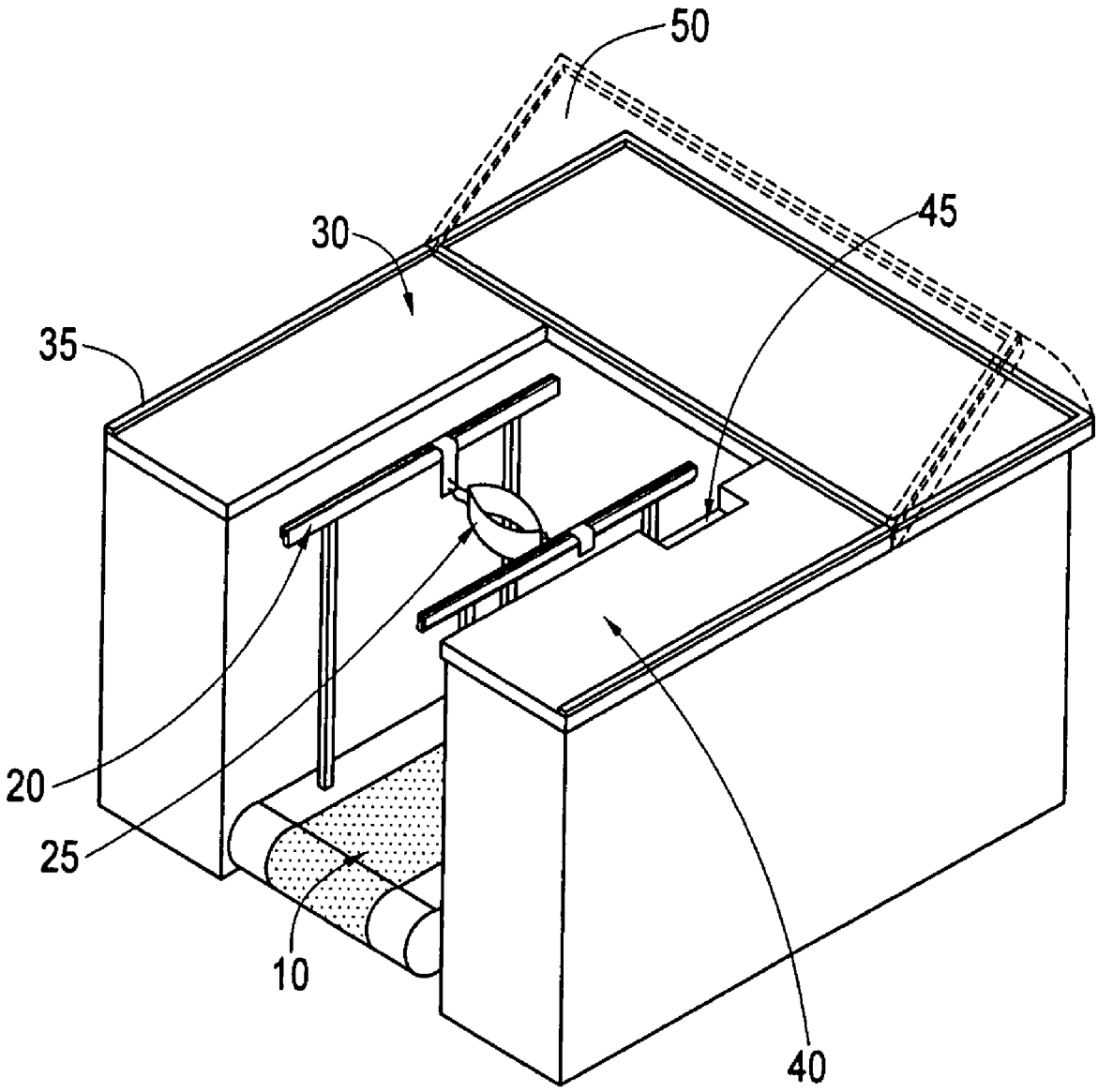
FIG. 1 is an isometric view of a treadmill system according to a preferred embodiment of the invention.
Figure 2:
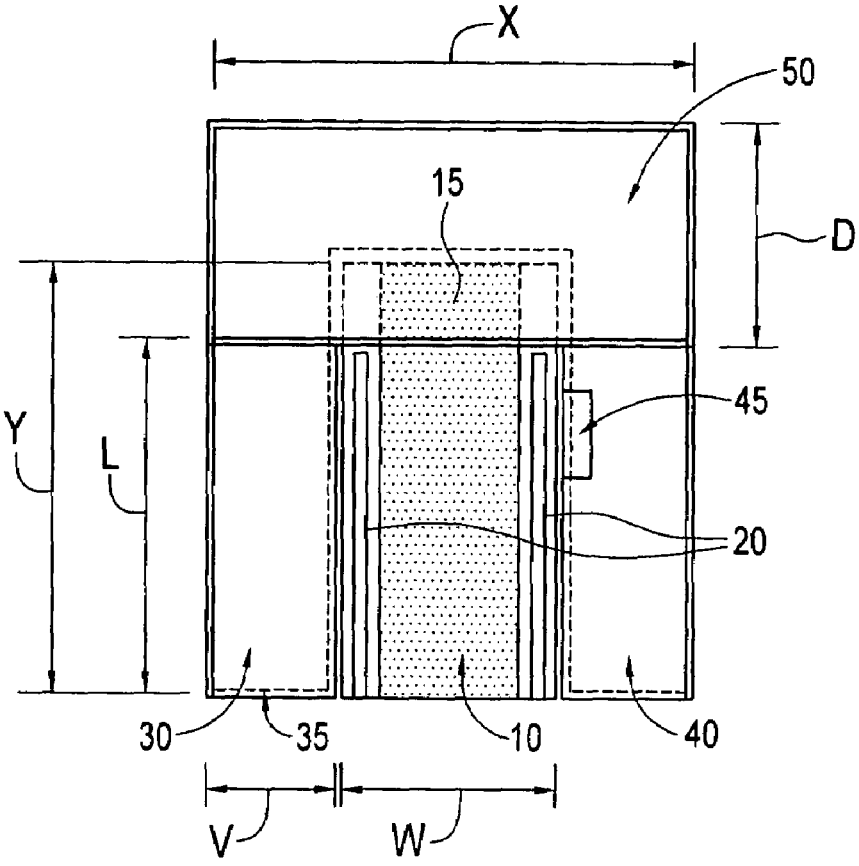
FIG. 2 is a plan view of the system of FIG. 1.
Figure 3:
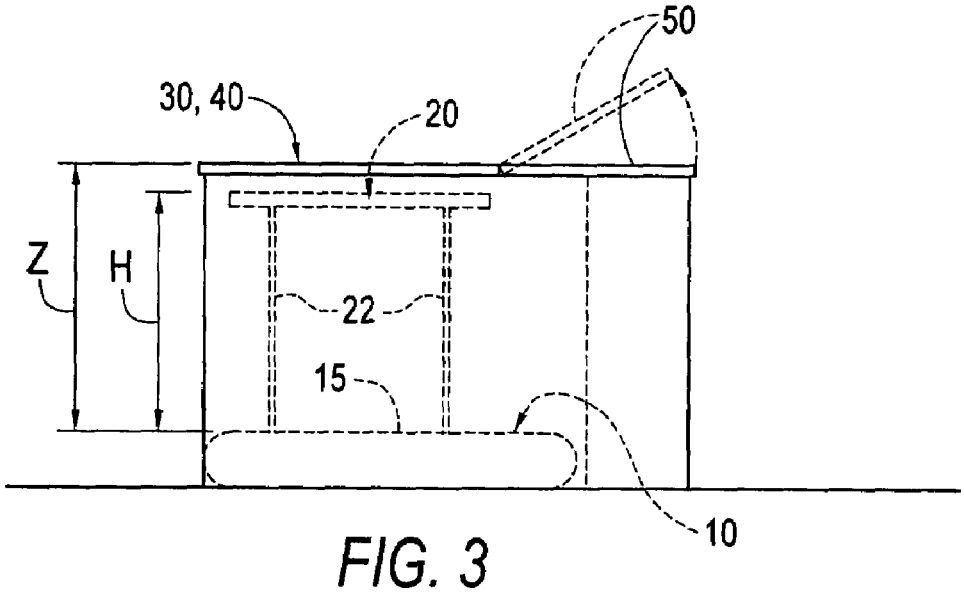
FIG. 3 is a side view of the system of FIG. 1.

Refer now to FIGS. 1 through 3, which illustrate an embodiment of the present invention. A treadmill 10 has a desired length L and width W of a walking surface 15. Two safety rails 20 are mounted longitudinally along both lateral sides of the treadmill 10. They are mounted on vertical supports 22 above the treadmill walking surface 15 at a height H within an arm's reach of the user when the treadmill 10 is in use. The safety rails 20 may be grasped by the user to obtain stability on the treadmill 10. The safety rails 20 are also used for anchoring a safety belt 25 that may be worn around a user's waist to inhibit the user from falling down onto the running surface of the treadmill. The safety belt 25 will be described in further detail below.

Along the left and right lateral sides of the treadmill 10, there are respective left and right work surfaces 30, 40. A control panel 45 for the treadmill 10 is shown recessed into the right work surface 40, although it may be located elsewhere within arm's reach of the user.

At the front of the treadmill, there is a front work surface 50. The front work surface 50 may be tilted, as shown in FIG. 2, in an adjustable fashion such that a user may face work materials at a selected angle.

Along the perimeter of all work surfaces 30, 40, 50, there is a pencil stop ledge 35. All of the work surfaces 30, 40, 50 are placed at a height Z above the surface 15 that is convenient to the user for working. The left and right work surfaces 30, 40 have a depth V and length Y and the front work surface 50 has a depth D and a length X sufficient for placing desired office working materials such as papers, books, office supplies, a telephone, and a computer.

Figure 4:
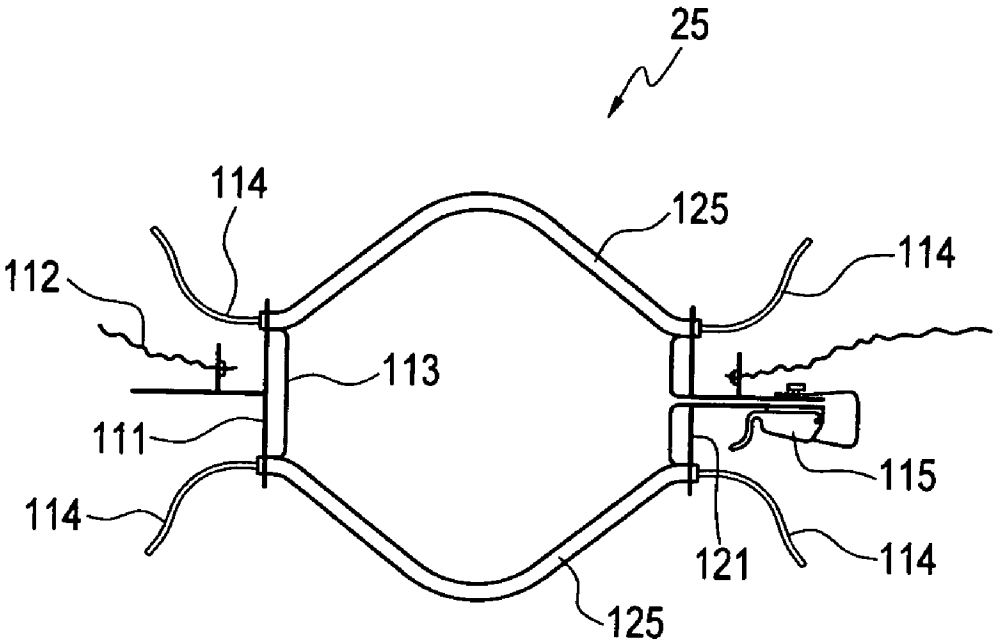
FIG. 4 is a view of the safety belt of the system of FIG. 1.
Figure 6:
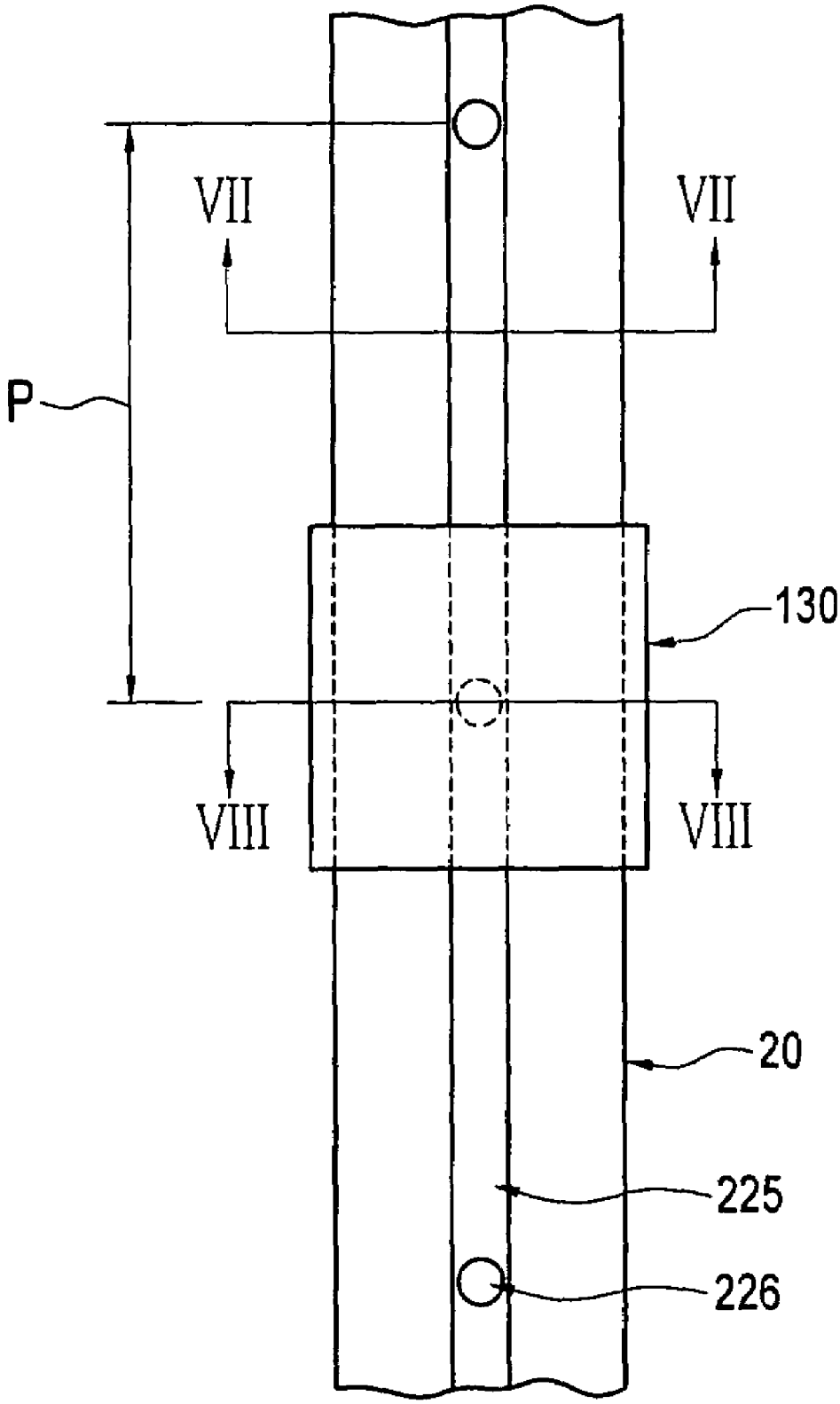
FIG. 6 is a top view of the safety rail of FIG. 1.

FIG. 4 illustrates a plan view of the safety belt 25 in an engaged position. The safety belt 25 has a belt portion 125 for wearing around the user's waist, and has a first plate 111 that, on a first side, attaches the belt portion 125 to an attachment cord 112 which is anchored to the safety rail 20. On a second side of the belt portion, padding 113 may be provided to prevent the plate 111 from rubbing against the user and increase the comfort of the user.

The safety belt 25 also has a draw string 114 for adjusting the length of the belt portion 125 according to the width of the user's waist. If the user's waist is thicker, the draw string 114 may be adjusted to accommodate the user's waist. If the user's waist is thinner, the draw string 114 may be pulled to narrow the safety belt 125 to accommodate the user's waist, and tied to hold the adjustment.

Figure 5:
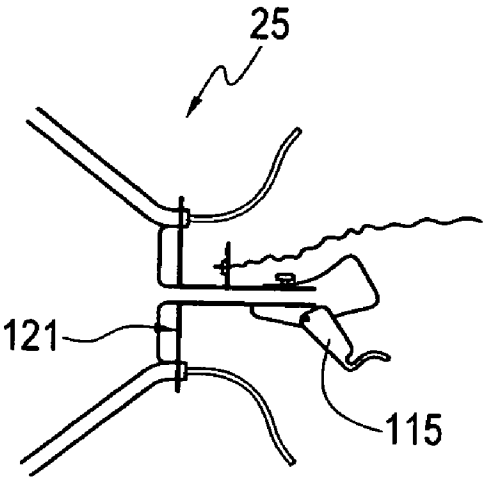
FIG. 5 is a view like FIG. 4.

The safety belt 25 also includes a locking mechanism 115 attached to a second plate 121 for locking the safety belt onto the user's waist. To remove the safety belt 25, the locking mechanism 115 may be disengaged, by flipping the locking mechanism 115 over, as shown in FIG. 5, thereby releasing the second plate 121 to unlock the safety belt 125.

FIGS. 6 through 8 and FIG. 10 are views of a portion of the safety rail 20. The safety rail 20 has a trench 225 opening to the top surface of the rail 20. The trench 225 has within it holes 226 at spaced at a predetermined distance P from each other. A J-bracket attachment 130 curls over the rail 20 and has a stopper 135 that engages a lip portion 137 to inhibit the attachment 130 from being entirely removed from the rail 20 during use. The attachment 130 also has a tab 131 that sits within the trench 225. When the attachment 130 is moved along the rail 20 and placed at a desired location along the rail 20, the tab 131 sits within a hole 226 in the trench 225, anchoring the attachment 130 at that location.

Figure 9:
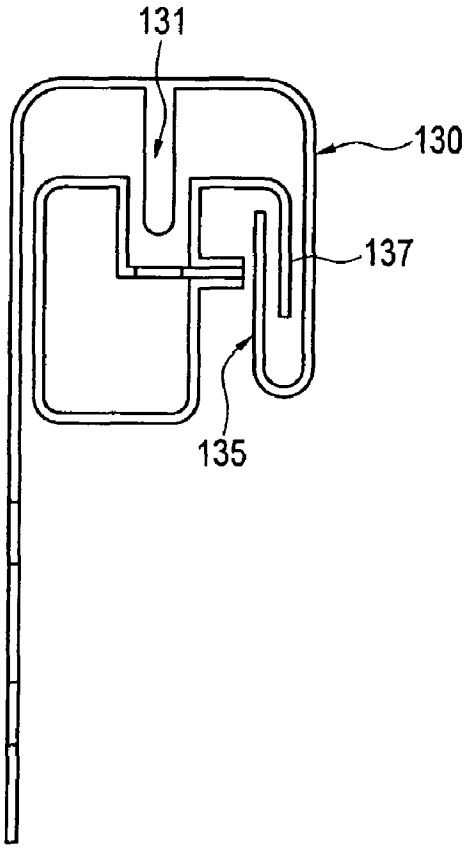
FIG. 9 is a view like FIG. 7 showing the safety belt attachment unengaged.
Figure 8:
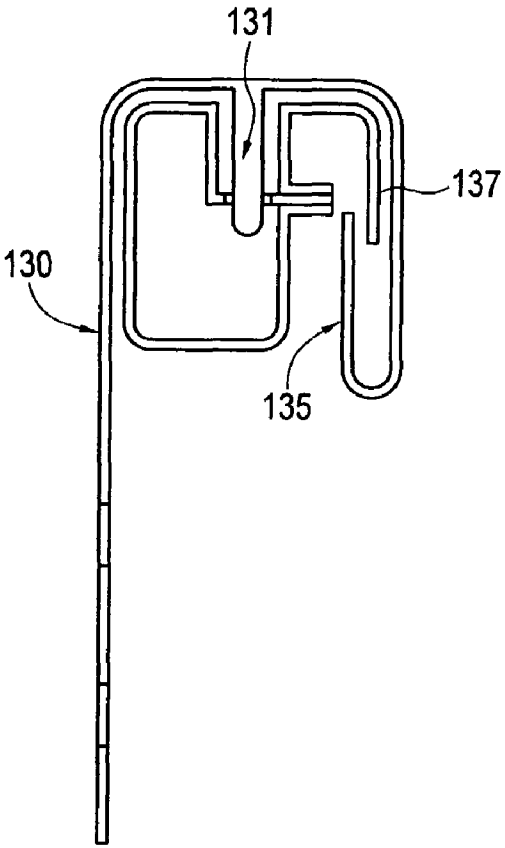
FIG. 8 is a view taken on section VIII-VIII of FIG. 6.
Figure 7:
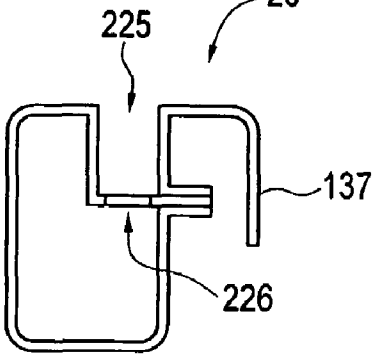
FIG. 7 is a view taken on section line VII-VII of FIG. 6.
Figure 10:
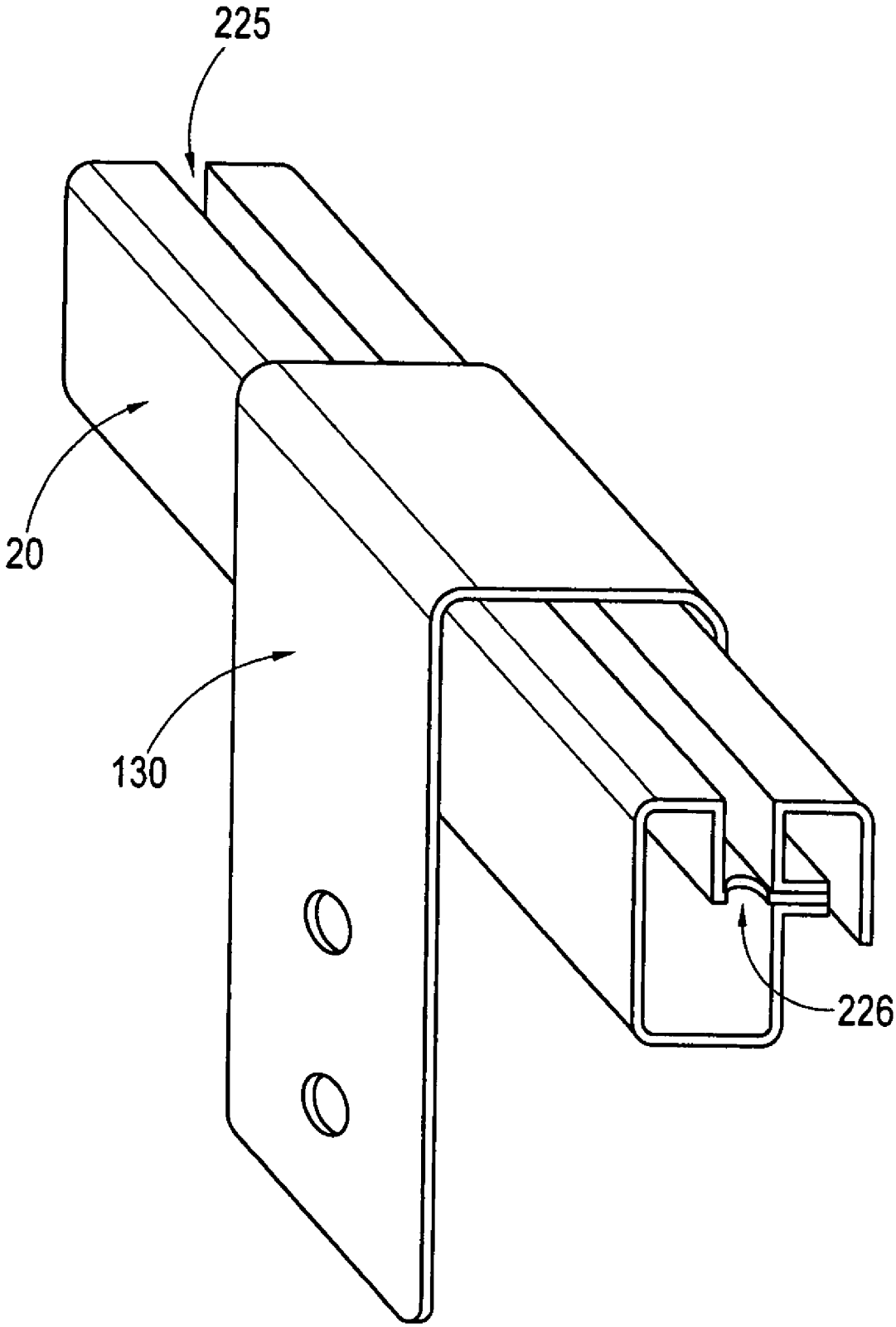
FIG. 10 is an isometric view of the safety rail of FIG. 1.

To move the attachment 130 to a different location along the trench 225, the attachment 130 may be disengaged by lifting the attachment 130 so that the tab 131 is fully withdrawn from the hole 226 and the attachment 130 may slide along the rail 20 to another hole 226, as shown in FIG. 9.

Figure 11:
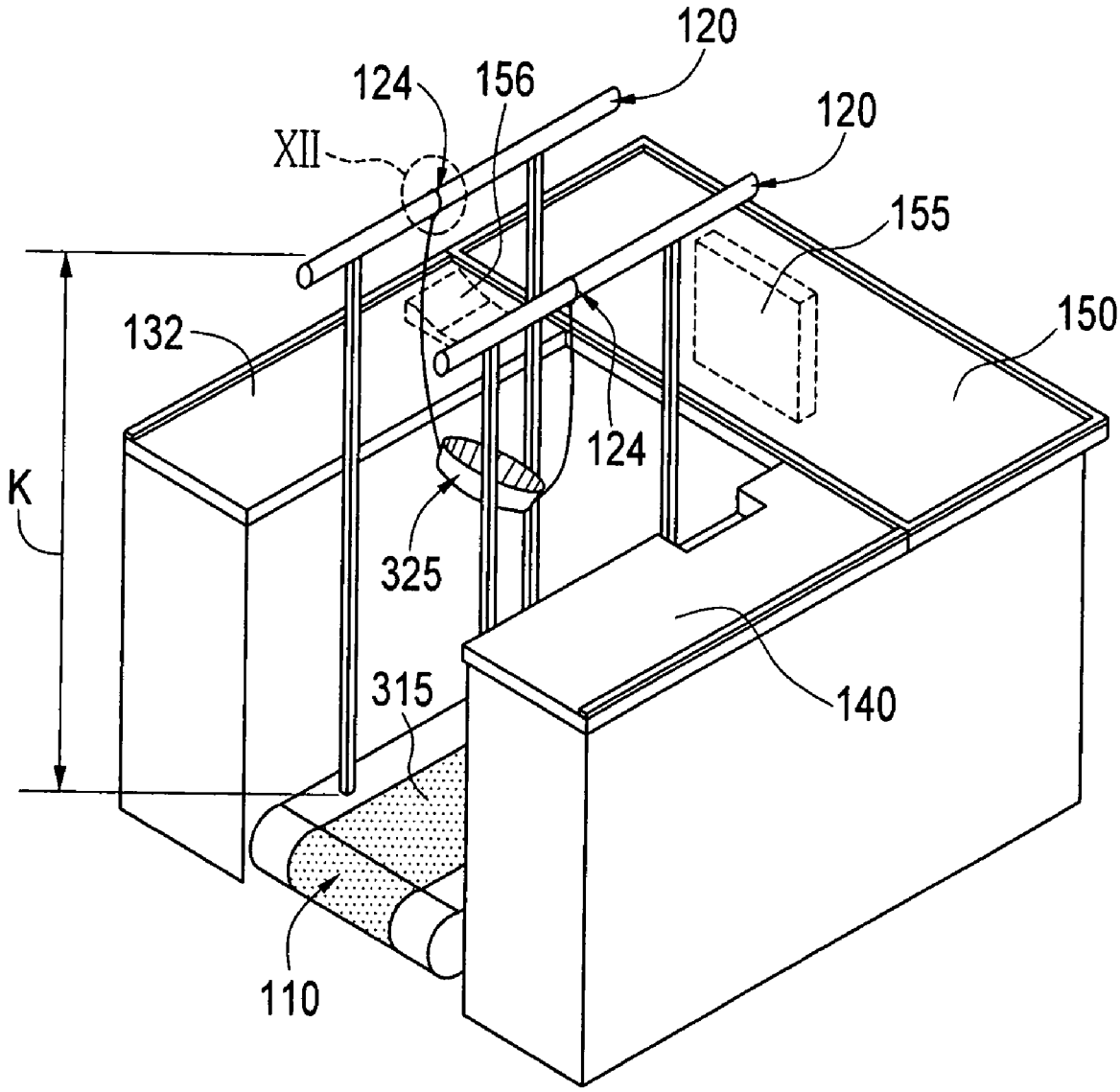
FIG. 11 is an isometric view of another embodiment of the invention.
Figure 12:
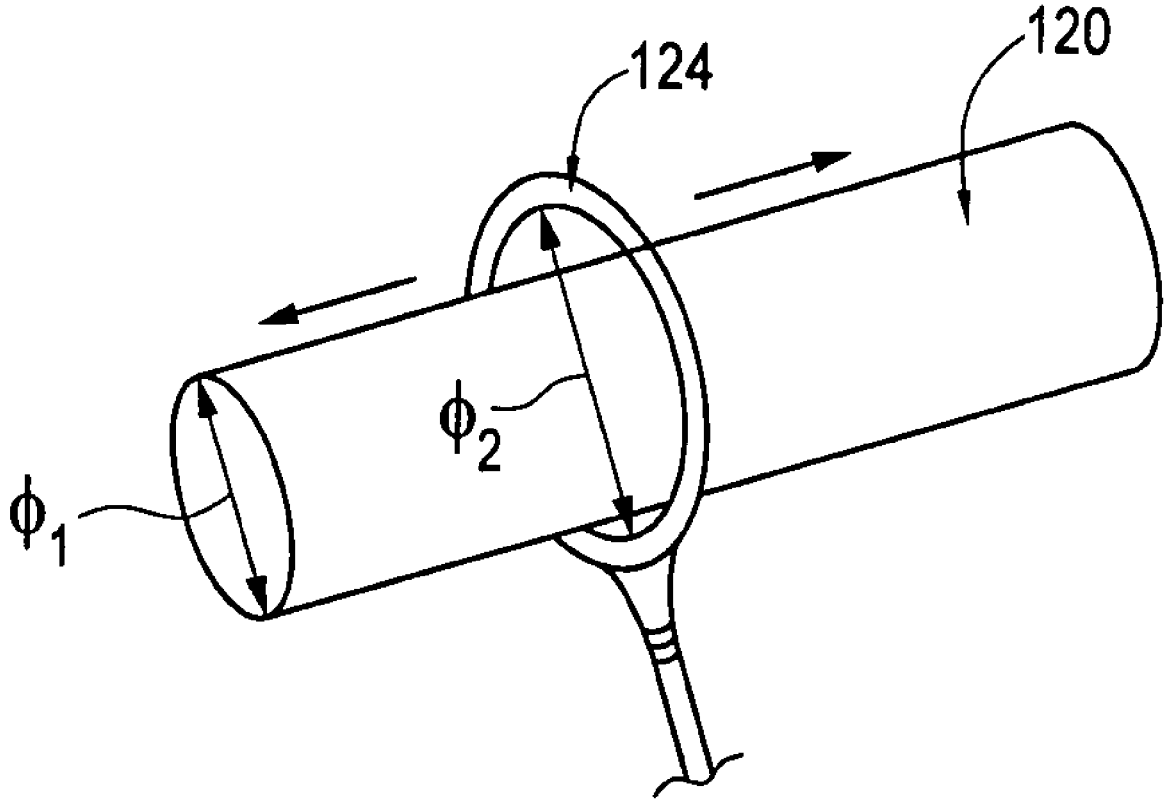
FIG. 12 is a close-up view of area XII of FIG. 11.

FIGS. 11 and 12 illustrate another embodiment of the present invention. A treadmill 110 is shown having pipe handrails 120 mounted longitudinally along both lateral sides of the treadmill 110. The pipe handrails 120 are mounted above the treadmill 110 at a height K.

The safety belt 325 is suspended from the handrails 120 by a pair of slide rings 124 which slide along the pipe handrails 120. When worn around a user's waist, the safety belt 325 provides additional protection against the user falling down onto the running surface of the treadmill 110. The safety belt 325 is anchored by the attachment cord 112 to the pipe handrails 120 at a height K sufficient to inhibit the torso of a fallen user from severely impacting the treadmill surface 315. This embodiment is particularly desirable for inhibiting heavier users from falling down and making injurious bodily contact with the running surface 315 of the treadmill 110. The dimensions and materials of the attachment cord 112, the vertical supports 22, the rails 120, the rings 124 and the belt 325, and associated structure are engineered to have sufficient strength to accomplish this purpose.

The pipe handrail 120 has an outer diameter $\phi_1$ and may be raised to a height along the treadmill such that it will support a user from falling down onto the surface 315 of the treadmill 110. The height K and length of the attachment cord 112 may be adjustable for accommodating different size users. For example, the vertical supports 22 may have telescoping sections that can be fixed at different heights with hole and pin arrangements (not shown).

A slide ring 124 having an inner diameter $\phi_2$ attaches to a safety belt and slides freely along the pipe handrail 120. The inner diameter $\phi_2$ of slide ring 124 is greater than the outer diameter $\phi_1$ of the pipe handrail 120.

It should be noted that although the pipe handrail 120 and slide ring 124 are both illustrated with a generally circular configuration, the invention is not limited to such a configuration. The pipe handrail may have a square, elliptical, rectangular or other configuration and the slide ring may have the same or a different configuration while maintaining an inner dimension that is larger than the outer dimension of the pipe handrail so that the slide ring may slide back and forth along the pipe handrail.

If a computer monitor 55, other computer accessories, and/or a telephone 56 are desired on the work surfaces 132, 140, 150, the work surfaces 132, 140, 150 may optionally be provided with holes through which wiring may connect to a hard drive that may be stored under the work surface or other wall sockets. The work surfaces 132, 140, 150 may also be provided with recesses for placement of the surface-top accessories.

While various embodiments of the present invention have been described above, it should be understood that they have been presented by way of example, and not limitation. It will be apparent to persons skilled in the relevant art that various changes in form and detail can be made therein without departing from the spirit and scope of the present invention. Thus, the present invention should not be limited by any of the above-described exemplary embodiments.

What is claimed as new and desired to be protected by Letters Patent of the United States is:

1. A treadmill system comprising:

a movable walking surface;

a pair of handrails each coupled to a respective side of the treadmill;

a safety belt anchored to each of the handrails by a respective attachment cord and configured to prevent an individual exercising on the treadmill from falling down onto the walking surface; and a work surface adjacent to the walking surface and configured to serve as a desk for the individual exercising on the treadmill, wherein each attachment cord is coupled to a respective handrail by a ring configured to slide longitudinally along the handrail.

2. The treadmill system of claim 1, wherein the handrails are located at a height above the walking surface less than a height of the work surface above the walking surface.

3. The treadmill system of claim 1, wherein the handrails are located at a height above the walking surface substantially equal to a height of the work surface above the walking surface.

4. The treadmill system of claim 1, wherein the handrails are located at a height above the walking surface greater than a height of the work surface above the walking surface.

5. The treadmill system of claim 1, wherein the work surface comprises at least first and second portions, the first portion being located in front of the treadmill and the second portion being located to a side of the treadmill.

6. The treadmill system of claim 5, wherein the work surface comprises a third portion being located on a side of the treadmill opposite the second work surface.

7. The treadmill system of claim 1, wherein an inclination of at least a portion of the work surface is adjustable.

8. The treadmill system of claim 1, wherein the work surface comprises a control panel configured to control at least one of a speed and an inclination of the walking surface.

9. The treadmill system of claim 8, wherein the control panel is recessed into the work surface.

10. The treadmill system of claim 1, wherein the work surface comprises a raised perimeter configured to prevent objects from rolling off the work surface.

11. The treadmill system of claim 1, wherein the work surface comprises at least one hole configured to permit an electrical wire to pass through the work surface.

12. The treadmill system of claim 1, wherein each ring is coupled to a respective handrail between vertical supports of the handrail such that the vertical supports prevent the ring from sliding off an end of the handrail.

13. The treadmill system of claim 1, wherein the ring is circular.

14. The treadmill system of claim 1, wherein the shape of the ring is the same as the shape of the handrail.

15. The treadmill system of claim 1, wherein the ring has an inner dimension greater than an outer dimension of the handrail.

16. A treadmill system comprising:

a work surface; and a treadmill adjacent to the work surface and comprising:

a walking surface;

first and second handrails, each handrail located on a respective side of the treadmill; and a safety harness coupled to the handrails via a respective attachment cord and a respective J-bracket, the attachment cord configured to couple the harness to the J-bracket and the J-bracket configured to slidably interface with a groove in the handrail, wherein the work surface is configured to serve as a desk for an individual exercising on the treadmill and the safety harness is configured to prevent the user from falling down onto the walking surface.

17. The treadmill system of claim 16, wherein a tab extending from the J-bracket is configured to interface with one of a plurality of holes in the handrail to prevent the J-bracket from sliding along the groove.

18. The treadmill system of claim 16, wherein the safety harness comprises:

first and second straps;

a first plate configured to couple a first end of the straps to a first attachment cord; and a second plate configured to couple a second end of the straps to a second attachment cord and further comprising a locking mechanism configured to secure the safety harness around the individual, wherein the first attachment cord is coupled to the first handrail and the second attachment cord is coupled to the second handrail.

19. The treadmill system of claim 18, further comprising padding on an interior side of each of the first and second plates.

20. The treadmill system of claim 18, further comprising a drawstring associated with each strap and configured to permit the individual to adjust the length of the respective strap.

* * * * *